United States Patent [19]

Hamm

[11] Patent Number: 4,592,380

[45] Date of Patent: Jun. 3, 1986

[54] GAS LIFT VALVE

[75] Inventor: Eddie J. Hamm, The Colony, Tex.

[73] Assignee: Otis Engineering Corporation, Dallas, Tex.

[21] Appl. No.: 725,568

[22] Filed: Apr. 22, 1985

Related U.S. Application Data

[63] Continuation of Ser. No. 516,650, Jul. 25, 1983, abandoned.

[51] Int. Cl.[4] ..... F04F 1/08

[52] U.S. Cl. ..... 137/155; 417/115

[58] Field of Search ..... 137/155; 417/115, 117

[56] References Cited

U.S. PATENT DOCUMENTS

| | | | |
|---|---|---|---|
| 2,519,242 | 8/1950 | Garrett et al. | 137/155 |
| 2,869,568 | 1/1959 | McCarvell | 137/155 |
| 4,124,195 | 11/1978 | Braun | 251/368 X |

*Primary Examiner*—Alan Cohan

*Attorney, Agent, or Firm*—Vinson & Elkins

[57] ABSTRACT

A gas lift valve having a bellows protecting valve and seat in which one of the bellows protecting valve and seat is constructed of polyimide material and a sleeve of polyimide material internal of the bellows protecting the bellows against distortion and wear.

11 Claims, 4 Drawing Figures

GAS LIFT VALVE

This application is a continuation, of application Ser. No. 06/516,650, filed 7/25/83 now abandoned.

This invention relates to valves and more particularly to gas lift valves.

Bellows-type gas lift valves have had the bellows protected in the past by providing an internal valve and seat controlling flow from the bellows into the pressure dome and filling the bellows with hydraulic fluid so that when the internal valve seats the trapped hydraulic fluid prevents a large differential from being applied across the wall of the bellows. Such valves of the abutment type have been constructed in the past from metal which have required that they be lapped to provide a good seal.

The application of a differential, even of limited extent, across a bellows has in the past sometimes resulted in deforming of the bellows. According to one manufacturing philosophy the bellows are prestressed by subjecting them to a high differential prior to being placed in service. The stressing of the bellows results in the bellows frequently becoming misaligned. This may result in the bellows rubbing against other parts reducing the life of the bellows. The distortion of the bellows also may result in misalignment of the main valve member and seat affecting the sealing effectiveness of the valve. This is particularly true where a conical valve member is used as misalignment of the valve member results in an elliptical shaped area of the valve member attempting to seat in a conical seat which impairs the affectiveness of the main valve member and seat to seal and prevent flow of fluid past the seat.

It is an object of this invention to provide a gas lift valve with an internal valve and seat to protect the bellows in which one of the valve and seat is constructed of polyimide material and the polyimide is protected against excess mechanical force.

Another object is to provide a gas lift valve with a sleeve of polyimide within the bellows to protect the bellows against distortion when subjected to a pressure differential.

Other objects, features and advantages of the invention will be apparent from the drawings, the specification and the claims.

In the drawings wherein an illustrative embodiment of this invention is shown, and wherein like reference numerals indicate like parts:

Figure 1:
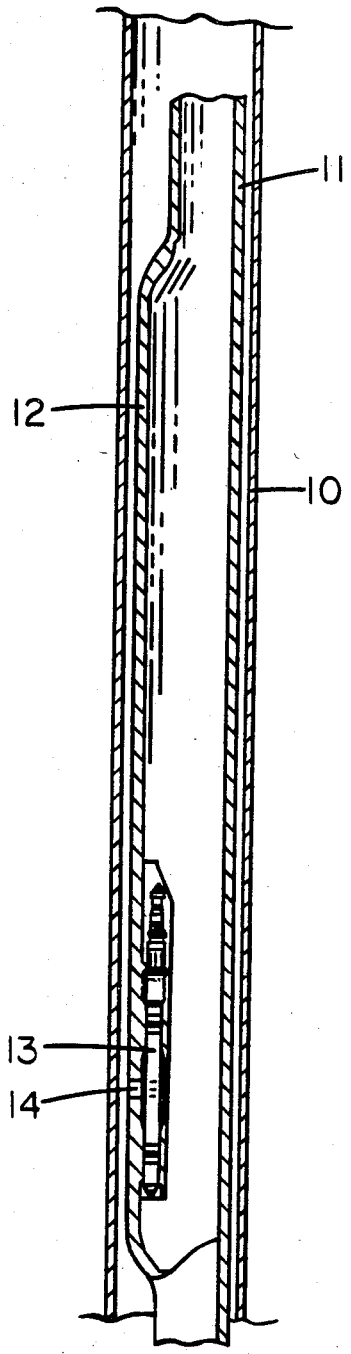
FIG. 1 is a sectional view through a portion of a well illustrating a gas lift valve of this invention in a side pocket mandrel.

The well section of FIG. 1 includes the casing 10 in which the tubing 11 including the side pocket mandrel 12 is suspended. Mounted in the side pocket mandrel 12 is a gas lift valve 13 constructed in accordance with this invention controlling flow of fluid through the port 14 in the side pocket mandrel 12.

Figure 2:
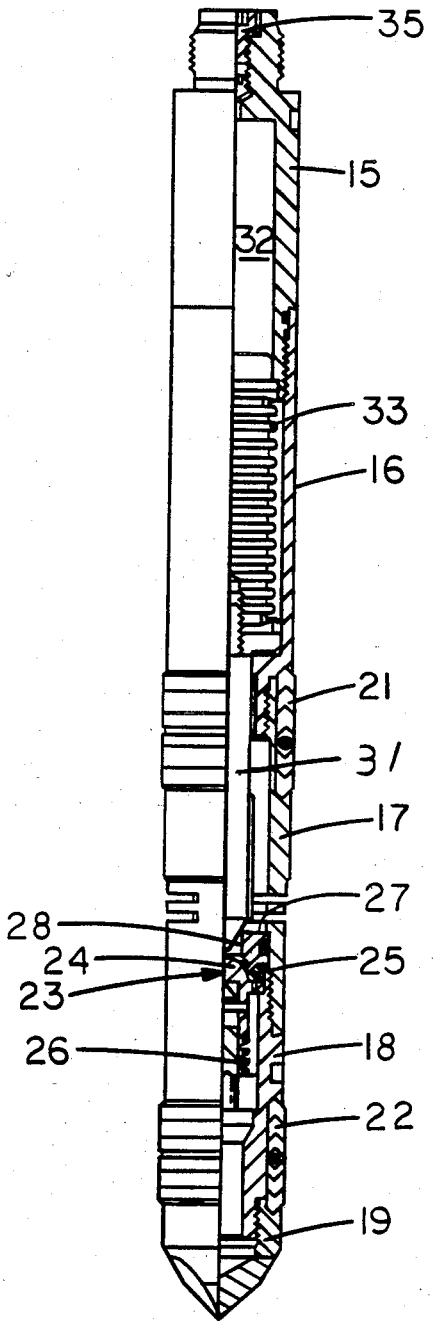
FIG. 2 is a view partly in elevation and partly in vertical quarter-section through the valve of this invention.
Figure 3:
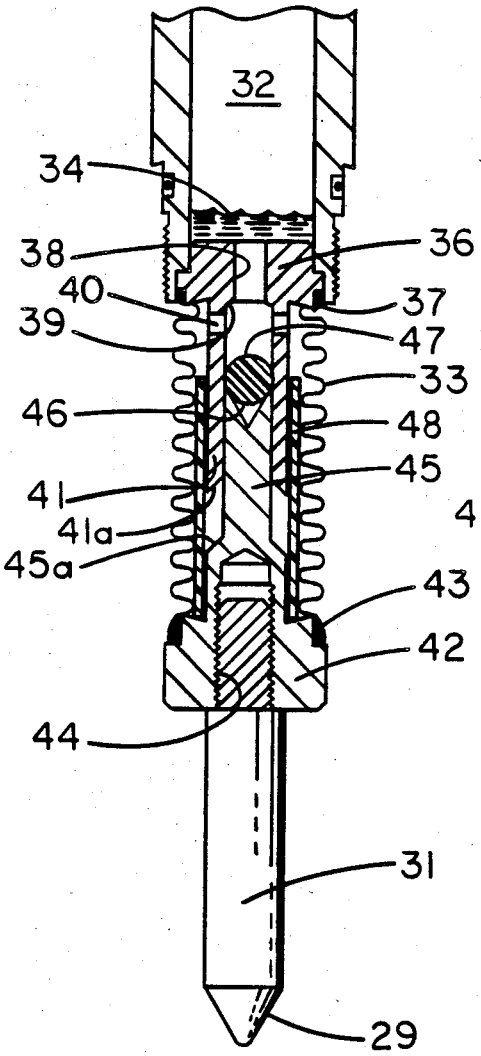
FIG. 3 is a view on an enlarged scale, partly in elevation and partly in cross-section through the valve member, bellows and lower portion of the pressure dome of the valve of FIG. 2.

Referring now to FIGS. 2 and 3, the preferred form of this invention is illustrated. The valve includes a body made up of the upper sub 15, bellows sleeve section 16, ported section 17, check valve section 18, and lower sub 19.

Upper external seal 21 is held between body sections 16 and 17. In like manner lower seal section 22 is held between the body sections 18 and 19. These seal sections sealingly engage the smooth bore portions of the valve receptacle of the side pocket mandrel 12 to seal between the valve and side pocket.

In conventional fashion a check valve, indicated generally at 23, includes the check valve member 24 cooperable with resilient seat 25 against which it is urged by the compression spring 26, to prevent back flow through the valve.

The resilient seat 25 of the check valve is carried by the main valve seat 27 which is supported within the body section 17. The main valve seat 27 has a cylindrical port or flowway 28 extending therethrough. While not shown in the drawings, the upper end of the seat at the top of this flowway 28 is chamferred to provide a conical valve seat in the conventional manner. The chamferred surface of the valve seat 27 is engaged by the conical nose 29 of the valve member 31.

Other conventional forms of valve member and cooperable seat may be utilized with this invention. The chamferred seat and conical nose 29 were selected to best illustrate the advantage of maintaining the valve member in alignment with the seat. If the valve member 31 be slightly cocked relative to the seat, then the seat engaging portion of the conical nose 29 is elliptical in shape and this elliptical surface is attempting to seal with the conical surface of the seat 27. This impairs the efficiency of the seal between the main valve member 31 and the main valve seat 27, and in accordance with this invention provision is made to prevent distortion of the bellows which results in such misalignment of the main valve member with the main valve seat.

In conventional fashion there is provided at the upper end of the valve a pressure dome 32 which includes the bellows 33. Within the pressure dome a hydraulic fluid, such as silicone 34, is provided for protecting the bellows in the conventional manner. The liquid has been omitted from the bellows in FIG. 3, but it will be understood by those skilled in the art that the entire bellows section 33 is filled with the liquid 34.

The pressure dome will be charged with a gas under pressure in the upper end of the dome through the charging port at the upper end of the upper sub 15. This charging port is shown to be closed by the plug 35.

Referring now to the bellows section of the valve, an upper bellows retainer 36 has secured thereto the upper end of the bellows 33 by solder 37. The upper bellows retainer 36 has a port 38 extending therethrough and at the lower end of the port an internal seat 39 is provided. Depending from the upper bellows retainer 36 is a tubular guide and stop 41.

The lower end of the bellows 33 is secured to the lower bellows retainer 42 by solder 43. The main valve member 31 is secured to the lower bellows retainer 42 by the threaded connection 44.

The lower bellows retainer 42 includes an upstanding valve rod 45 which has a telescoping relationship with the guide and stop 41. As the valve rod 45 reciprocates within the guide and stop 41, it acts as a guide to hold the main valve 31 in general alignment with the main valve seat 27. The clearance between the valve rod 45 and the guide and stop 41 is such that it will generally hold the valve 31 in proper position but will permit slight cocking of the main valve member 31 relative to its seat.

The upper end of the connecting rod 45 is provided with an upwardly facing surface 46 supports the valve member 47 and forces it to engage the seat 39 to trap hydraulic fluid within the bellows and prevent distortion of the bellows when subjected to a differential.

In accordance with this invention one of the valve and seat and preferably the valve ball 47 is constructed of polyimide material. While it is preferred to use substantially pure polyimide, additives may be included to give desired characteristics. This material has the characteristic of providing a seal with the metal seat 39 without the necessity of lapping the valve and seat. The polyimide material has the desirable characteristic of not being grooved as a result of being forced against the seat 39 and it has been found that the polyimide ball will provide a good seal with the seat 39 after being subjected to cycles of operation commensurate with normal life of a gas lift valve.

The surface 46 on the valve rod 45 may take any desired form such as the conical recess shown as its function is to move the inner valve member 47 against its seat where differential pressure across the valve member 47 will cause the valve member to seal with seat 39.

A polyimide ball seated against a small seat under hydraulic pressure caused by usual differentials found in gas lift installations can withstand the hydraulic forces present. It cannot, however, withstand the mechanical forces resulting from the differential across the effective area of the bellows which is much larger than the area of seat 39. The valve, therefore, is designed to cause the main valve in opening to seat the internal valve, and thereafter the main valve is prevented from exerting any additional mechanical force which might deform and damage the ball valve member 47.

Figure 4:
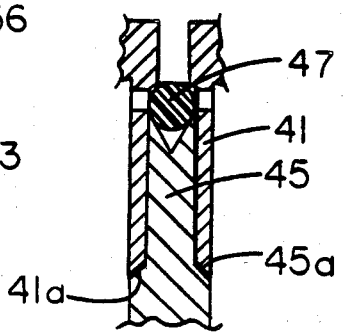
FIG. 4 is a fragmentary view similar to FIG. 3 showing the internal valve seated.

Preferably, the lower end 41*a* of guide and stop 41 is engaged by an upwardly facing shoulder 45*a* on the valve rod 45 as the inner valve member 47 engages seat 39 to limit upward travel of the valve rod 45 as illustrated in FIG. 4. Hydraulic fluid is effective on the valve member 47 and free access to the interior of guide and stop 41 is provided by ports 40 in guide and stop 41. The ball seals against upward flow of fluid and protects the bellows, while at the same time upward movement of the main valve is arrested to protect the ball valve 47.

In accordance with this invention the bellows 33 is protected against distortion due to a differential thereacross. For this purpose a sleeve 48 of polyimide material is provided within the bellows and is sized to have sliding contact with the bellows 33. polyimide is a very slick material and contact between the polyimide sleeve and the bellows will result in very little wear on the polyimide sleeve and substantially no wear on the harder bellows material thus protecting the bellows against failure at a point of frictional contact with some other part of the valve in the absence of the sleeve. As the polyimide sleeve 48 is in sliding contact with the bellows 33 when the bellows is subjected to a differential, the bellows is prevented from distorting and misaligning the valve member 31. Even if it is desired to prestress the bellows, that is, subject it to a substantial differential during manufacture, the presence of the polyimide sleeve will protect the bellows against distortion in being prestressed to the extent that the bellows would misalign the valve member 31. It will be noted that the sleeve when in its full down position extends to a point just below the upper surface of the internal valve 47. Thus, with the internal valve on its seat 39, the sleeve is spaced slightly from the upper bellows retainer 36 but is in engagement with all of the inner convolutions of the bellows 33 to thus protect the bellows and prevent it from distorting when the valve 31 is in full open position.

During assembly the bellows is soldered to one of the bellows retainers. The sleeve is then inserted and forced into engagement with this one bellows retainer. This will space the sleeve from the other bellows retainer and the other bellows retainer may then be soldered to the bellows. In this manner damage to the polyimide sleeve is avoided.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A gas lift valve comprising, a body, a main valve seat in the body, a main valve member cooperable with the seat to control flow through the body, a pressure dome including a depending bellows connected to said valve member, said bellows being exposed to pressure within the dome urging said valve member toward said seat and to pressure exterior of said body urging said valve member away from said seat, an internal valve seat between said bellows and the remainder of said dome, an internal valve member separate from and movable relative to and supported on said main valve member and cooperable with said internal valve seat to control flow therethrough, one of said internal valve member and seat constructed of polyimide material, hydraulic fluid in said dome extending to a level above said internal valve seat, and a sleeve of polyimide material having a sliding engagement with the interior of said bellows and supporting said bellows against distortion when subjected to a differential pressure thereacross.

2. The valve of claim 1 wherein said internal valve member is a ball constructed of polyimide material.

3. The valve of claim 1 wherein said bellows is sealingly secured at its upper end to an upper bellows retainer and at its lower end to a lower bellows retainer, said upper bellows retainer including said internal valve seat and a depending tubular guide, said lower bellows retainer secured to said main valve member and including an upstanding valve rod telescoping with said tubular guide to maintain said main valve member in alignment with said main valve seat, said valve rod having a spherically shaped upper end conforming to and supporting said internal valve member, and said internal valve member is a ball constructed of polyimide material.

4. The valve of claim 1 wherein said bellows is sealingly secured at its upper end to an upper bellows retainer and at its lower end to a lower bellows retainer, said upper bellows retainer includes said internal valve seat and a depending tubular guide, said lower bellows retainer secured to said main valve member and includes an upstanding connecting rod telescoping with said tubular guide to maintain said main valve member in alignment with said main valve seat, said connecting rod has an upper end supporting said internal valve member, said internal valve member is a ball constructed of polyimide material, and wherein said sleeve is slightly shorter in length than said bellows with said internal valve member seated.

5. A gas lift valve comprising, a body, a main valve seat in the body, a main valve member cooperable with the seat to control flow through the body, a pressure dome including a depending bellows connected to said valve member, said bellows being exposed to pressure within the dome urging said valve member toward said seat and to pressure exterior of said body urging said valve member away from said seat, an internal valve seat between said bellows and the remainder of said dome, an internal valve member separate from and movable relative to and supported on said main valve member and cooperable with said internal valve seat to control the flow therethrough, one of said internal valve member and seat constructed of polyimide material, hydraulic fluid in said dome extending to a level above said internal valve seat, and stop means limiting movement of said main valve member away from its seat after it has seated said internal valve member to limit the mechanical force exerted on said internal valve member.

6. The valve of claim 5 wherein said internal valve member is a ball constructed of polyimide material.

7. The valve of claim 5 wherein said bellows is sealingly secured at its upper end to an upper bellows retainer and at its lower end to a lower bellows retainer, said upper bellows retainer includes said internal valve seat and a depending tubular guide, said lower bellows retainer is secured to said main valve member and includes an upstanding valve rod telescoping within said tubular guide, said valve rod supports said internal valve member and moves said internal valve member onto its seat as the main valve member moves away from its seat, an upwardly facing shoulder on said valve rod engages said tubular guide simultaneously with movement of said internal valve member onto its seat and prevents further movement of said main valve member away from its seat to protect the internal valve against mechanical pressure; and said internal valve member is a ball constructed of polyimide material.

8. The valve of claim 5 wherein the gas lift valve includes a sleeve of polyimide material having a sliding engagement with the interior of said bellows and supporting said bellows against distortion when subject to a differential pressure thereacross.

9. The valve of claim 6 wherein the gas lift valve includes a sleeve of polyimide material having a sliding engagement with the interior of said bellows and supporting said bellows against distortion when subject to a differential pressure thereacross.

10. The valve of claim 7 wherein the gas lift valve includes a sleeve of polyimide material having a sliding engagement with the interior of said bellows and supporting said bellows against distortion when subject to a differential pressure thereacross.

11. A gas lift valve comprising, a body, a main valve seat in the body, a main valve member cooperable with the seat to control flow through the body, a pressure dome including a depending bellows connected to said valve member, said bellows being exposed to means urging said valve member toward said seat and to pressure exterior of said body urging said valve member away from said seat, an internal valve seat between said bellows and the remainder of said dome, an internal valve member separate from and movable relative to and supported on said main valve member and cooperable with said internal valve seat to control the flow therethrough, one of said internal valve member and seat constructed of polyimide material, hydraulic fluid in said dome extending to a level above said internal valve seat, and stop means limiting movement of said main valve member away from its seat after it has seated said internal valve member to limit the mechanical force exerted on said internal valve member.

* * * * *